US006907639B2

(12) United States Patent
Chelednik et al.

(10) Patent No.: US 6,907,639 B2
(45) Date of Patent: Jun. 21, 2005

(54) PAINT ROLLER

(75) Inventors: Edward Chelednik, Olmstead Township, OH (US); Frank Chelednik, North Olmstead, OH (US); Virginia Chelednik, North Olmstead, OH (US)

(73) Assignee: Frank's Creative Idea's, Inc., Olmstead Township, OH (US)

( * ) Notice: Subject to any disclaimer, the term of this patent is extended or adjusted under 35 U.S.C. 154(b) by 108 days.

(21) Appl. No.: 10/357,798

(22) Filed: Feb. 4, 2003

(65) Prior Publication Data

US 2004/0148726 A1 Aug. 5, 2004

(51) Int. Cl.[7] ..... B05C 1/00; B05C 17/02
(52) U.S. Cl. ..... 15/230.11; 492/47; 15/230
(58) Field of Search ..... 15/230, 230.11; D4/122; 401/197; 492/47

(56) References Cited

U.S. PATENT DOCUMENTS

| | | | | |
|---|---|---|---|---|
| 700,499 | A | | 5/1902 | Irving |
| 1,573,663 | A | | 2/1926 | Warren |
| 2,401,842 | A | | 6/1946 | Slater |
| 2,763,022 | A | | 9/1956 | Glacken |
| 2,766,473 | A | | 10/1956 | Thackara |
| 3,156,938 | A | | 11/1964 | Bills |
| 3,342,325 | A | | 9/1967 | Dreher |
| 3,711,887 | A | | 1/1973 | Chapman |
| 3,906,581 | A | | 9/1975 | Marino et al. |
| 4,402,102 | A | | 9/1983 | Al-samman |
| 4,467,509 | A | * | 8/1984 | Dezen ..... 492/19 |
| 4,738,358 | A | | 4/1988 | Kehl |
| 5,123,576 | A | * | 6/1992 | Lawrence ..... 222/570 |
| 5,613,264 | A | | 3/1997 | Knowles |
| 5,755,004 | A | * | 5/1998 | Miller ..... 15/230.11 |
| 5,806,129 | A | | 9/1998 | Nelson ..... 15/230.11 |
| 6,012,196 | A | | 1/2000 | Weiss ..... 15/230.11 |
| 6,098,240 | A | | 8/2000 | Taylor ..... 15/230.11 |
| 6,185,780 | B1 | | 2/2001 | Napolitan |
| 6,347,426 | B1 | | 2/2002 | Weiss ..... 15/230.11 |
| 2003/0074759 | A1 | * | 4/2003 | Er ..... 15/230.11 |
| 2003/0233721 | A1 | | 12/2003 | Prince et al. |

FOREIGN PATENT DOCUMENTS

| | | |
|---|---|---|
| DE | 29717509 | 2/1999 |
| GB | 1010288 | 11/1965 |

OTHER PUBLICATIONS

International Search Report for PCT/US04/003129 dated Jul. 28, 2004.

* cited by examiner

*Primary Examiner*—Robert J. Warden, Sr.
*Assistant Examiner*—Laura C Cole
(74) *Attorney, Agent, or Firm*—Dinsmore & Shohl LLP

(57) ABSTRACT

An improved paint roller for easy removal from a paint roller frame having a paint roller tube, an end cap and a removal interface attached to the end cap. The end cap attaches to, attached within, or is part of the distal end of the paint roller tube. The removal interface is configured to aid in removal of the paint roller from a paint roller frame.

17 Claims, 6 Drawing Sheets

PAINT ROLLER

TECHNICAL FIELD

The present invention relates to an improvement to a paint roller to allow a user to remove the paint roller from the paint roller frame while minimizing paint contacting the user.

BACKGROUND OF THE INVENTION

Paint rollers are extremely popular for painting projects, especially for do-it-yourself (DIY) type projects. Paint rollers are a fast, simple and effective way of applying paint to large areas. Paint rollers have three major components: core, adhesive, and fabric. The core is the base of the paint roller. The core can be constructed from a wide range of materials known to one skilled in the art (e.g. plastic, cardboard, and phenolic-impregnated materials). The type of core typically is based on the type of paint to be applied as well as desired durability and potential re-use of the paint roller. Untreated cardboard cores are typically utilized in throwaway or disposable covers.

An adhesive is applied to the outside of the core and is utilized to attach the fabric. Typically, the adhesive is epoxy based. Other adhesives known to one skilled in the art are also utilized. The fabric of the roller typically comprises fibers woven or knitted to a backing and adhesively applied to the roller core. Fabrics include natural fibers (e.g. wool, mohair, and lambskin) as well as synthetic fibers (e.g. nylon, polyester, acrylic, rayon, and blends of one or more synthetic fibers).

A paint roller frame is typically utilized to support a paint roller and apply paint to a surface. In order to keep the paint roller securely attached to the paint roller frame and prevent the paint roller from sliding off the paint roller frame, the paint roller frame is configure to provide a snug fit for the paint roller. However, after the paint roller has been used to apply paint to a surface, a user typically must remove the paint roller from the paint roller frame for either cleaning or disposal of the paint roller. Due to the snug fit, a user typically has to apply one or more digits of their hands onto the fabric (nap) of the paint roller to gain leverage to slide the paint roller off of the paint roller frame. This typically results in the user having paint contacting the user's skin or clothes. In addition, the paint roller covered with paint can often provide a slippery surface further frustrating the removal process. As such, it is desired to have a paint roller that allows removal of the paint roller from a paint roller frame while minimizing paint contacting the user.

SUMMARY OF THE INVENTION

Accordingly, it is an object of the present invention to provide a novel paint roller which overcomes one or more disadvantages of the prior art.

It is a more specific object of the invention to provide a paint roller which is configured to allow a user to remove the paint roller from a paint roller frame while minimizing contact of paint with the user.

These and additional objects and advantages are provided by the paint roller of the present invention.

More particularly, an improved paint roller for easy removal from a paint roller frame is provided. The paint roller comprises: a paint roller tube having an outer surface and a proximal and distal end, wherein the outer surface of the paint roller tube comprises a paint receiving substrate; an end cap attached to the distal end of the paint roller tube; and a removal interface attached to or part of the end cap, wherein the end cap and the removal interface are configured to aid in removal of the paint roller tube from a paint roller frame.

Still other objects, advantages and novel features of the present invention will become apparent to those skilled in the art from the following detailed description, which is simply by way of illustration various modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENT

Reference will now be made in detail to various embodiments of the invention, examples of which are illustrated in the accompanying drawings, wherein like numerals indicate the same element throughout the views.

Figure 1:
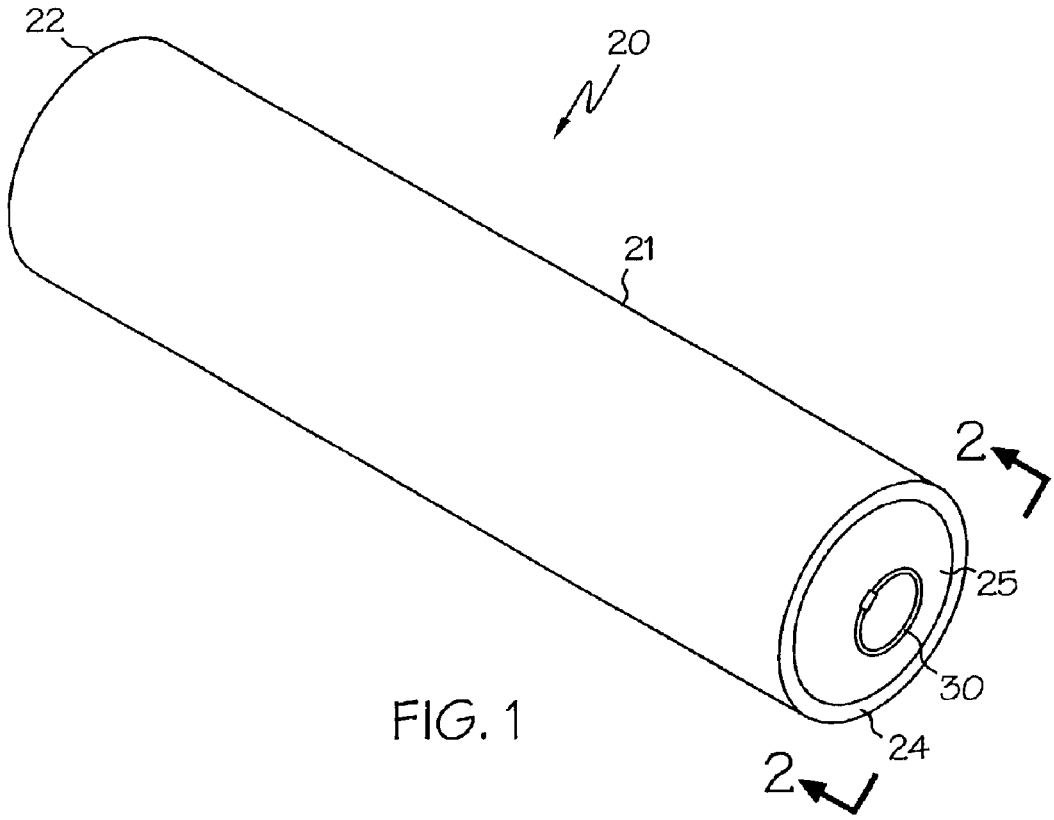
FIG. 1 depicts a schematic illustration of an exemplary paint roller according to the present invention.

FIG. 1 depicts an exemplary embodiment of the improved paint roller 20 of the present invention. The paint roller 20 has a paint roller tube 21 having a proximal end 22 and a distal end 24. Attached to the distal end 24 of the paint roller tube 21 is an end cap 25. The end cap 25 has a removal interface 30 (e.g. ring) attached to or part of the end cap 25, wherein the removal interface 30 is configured to aid in removal of the paint roller 20 from a paint roller frame by allowing a user to insert a digit into the removal interface 30 to remove the paint roller 20 from the paint roller frame. The end cap 25 can be attached to or within the distal end of the paint roller 20 by various attachment technologies known to one skilled in the art. For example, exemplary attachment technologies include adhesives, chemical bonding, heat sealing, and screw threads. The end cap 25 can be constructed from various materials known to one skilled in the art. Such materials include plastics, metals, ceramics, composites, and wood. In one embodiment, the end cap 25 is formed integral with the paint roller. For example, the end cap may be molded or extruded as part of the paint roller.

Figure 2:
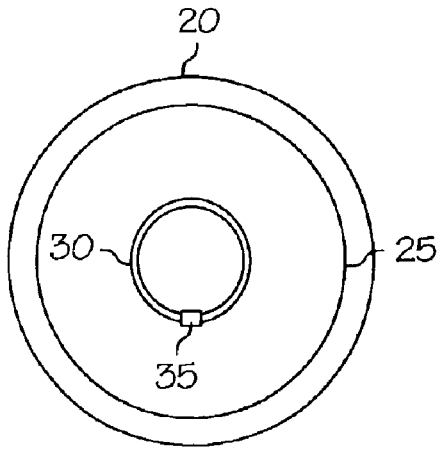
FIG. 2 depicts a schematic illustration of an end view of an exemplary paint roller according to the present invention drawn along the line 2—2 of FIG. 1.

FIG. 2 depicts an end view of the improved paint roller 20. In one exemplary embodiment, a ring securing bracket or hinge 35 secures a ring 30 to the end cap 25 of the paint roller 20. The securing bracket or hinge 35 may be configured to allow the ring 30 to be removable from the end cap 25. In one embodiment, the ring 30 can be removed to allow reuse of the paint roller 20. After reuse of the paint roller 20, the ring 30 can be reattached to the end cap 25 of the paint roller to aid in removal of the paint roller from the paint roller frame.

Figure 3:
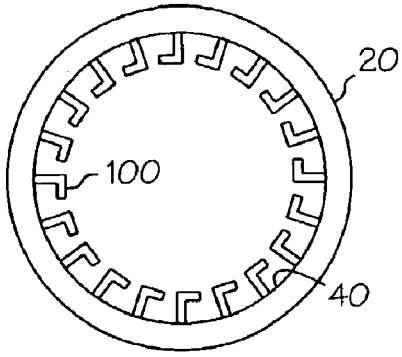
FIG. 3 depicts a schematic illustration of an end view of an exemplary paint roller according to the present invention.
Figure 4:
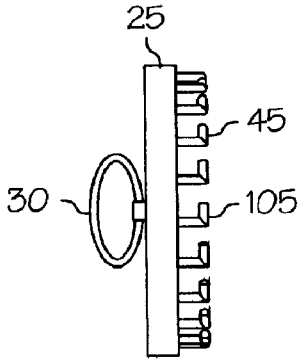
FIG. 4 depicts a schematic illustration of an exemplary end cap according to the present invention.
Figure 14:
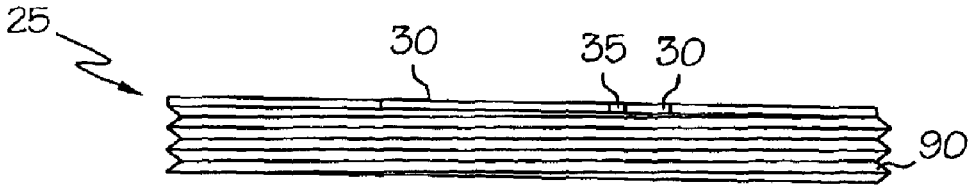
FIG. 14 depicts a schematic cross-section illustration of an exemplary end cap according to the present invention.

Another exemplary embodiment of the present invention is depicted in FIG. 3. An improved paint roller 20 comprises an end cap female coupler 40 at the distal end 24 of the paint roller 20. The end cap female coupler 40 is configured to receive an end cap having a male coupler 45 as depicted in FIG. 4 to secure the end cap 25 to the distal end 24 of the paint roller 20. The end cap female coupler 40 and male coupler 45 may be configured in various socket/adapter technologies known to one skilled in the art. For example, as depicted in FIG. 3, the end cap female coupler comprises teeth 100 which interlock with corresponding teeth 105 of the end cap male coupler 45. Other attachment technologies for the end cap 25 to be connected to the distal end 24 of the paint roller 20 include screw threads 90 in FIG. 14 on the end cap 25 and corresponding threads 90 on the paint roller 20 (page 9) to receive the end cap 25 on the distal end 24 of the paint roller 20. The end cap 25 can be attached to the distal end 24 of the paint roller 20 after the paint roller 20 has been utilized in painting operations and is now ready to be removed from the paint roller frame. The paint roller 20 may comprise a removable mask 50 which can be removed to prevent the threads 90 on the distal end 24 of the paint roller 20 from being fouled by paint. The end cap 25 can then be screwed on and attached to the paint roller 20 and the removal interface 30 on the end cap 25 can then utilized to remove the paint roller 20 from the paint roller frame.

Figure 5:
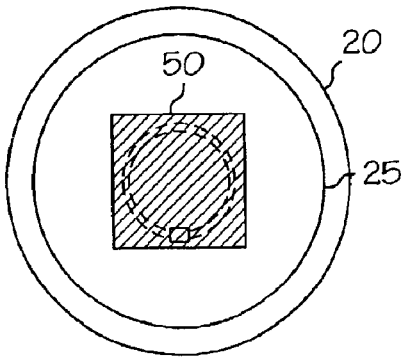
FIG. 5 depicts a schematic illustration of an end view of an exemplary paint roller according to the present invention.
Figure 6:
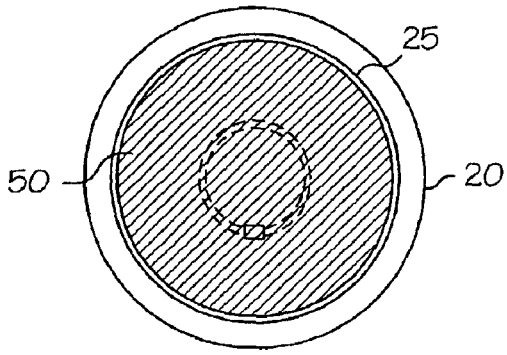
FIG. 6 depicts a schematic illustration of an end view of an exemplary paint roller according to the present invention.

In another exemplary embodiment of the present invention, as depicted in FIG. 5, the end cap 25 of the improved paint roller 20 comprises a removable mask 50 which covers at least a portion of the end cap 25 of the paint roller 20. The removable mask 50 is configured to prevent paint from contacting the ring 30 on the end cap 25 of the paint roller 20. The mask 50 can then be removed partially or entirely to expose the ring 30 by a user after the paint roller 20 has been used and the user can then insert a digit into the ring 30 without paint interfering with the operation of the ring and minimizing paint on the user's digit. The removable mask 50 may be selected from any material known to one skilled in the art which will prevent or minimize paint from contacting the ring 30 on the end cap 25. Exemplary removable mask 50 materials comprise metal foil, plastic sheet, paper and other woven and non-woven materials of natural and synthetic origins. The mask 50 may be applied and secured to the end cap 25 by any method known to one skilled in the art. For example, the mask 50 can be secured to the end cap 25 by induction, conduction, chemical bonding or adhesives. In one exemplary embodiment as depicted in FIG. 6, the removable mask 50 covers the entire end cap 25 of the improved paint roller 20.

Figure 9:
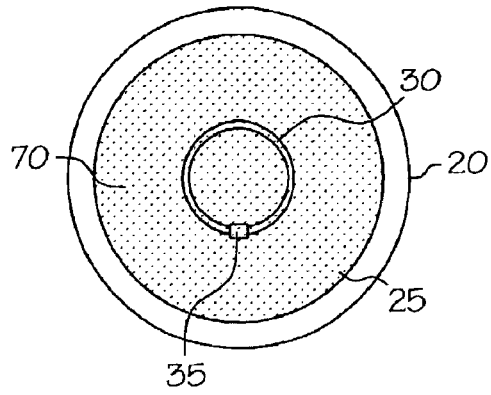
FIG. 9 depicts a schematic illustration of an end view of an exemplary paint roller according to the present invention.

In one exemplary embodiment, the removable mask 50 is further coated with a non-stick surface. Alternatively, the end cap 25 may be coated with a non-stick coating 70 as shown in FIG. 9 or be configured from non-stick materials. Non-stick is defined as a coating or surface in which paint contact is minimized. Exemplary non-stick coating materials comprise silicon based and fluorocarbon (PTFE) based materials. An alternative embodiment, the end cap 25 may be configured from a material which has non-stick properties.

Figure 7:
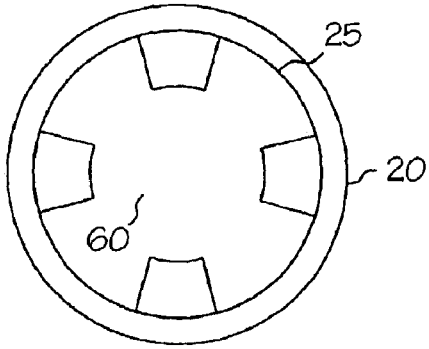
FIG. 7 depicts a schematic illustration of an end view of an exemplary paint roller according to the present invention.
Figure 8:
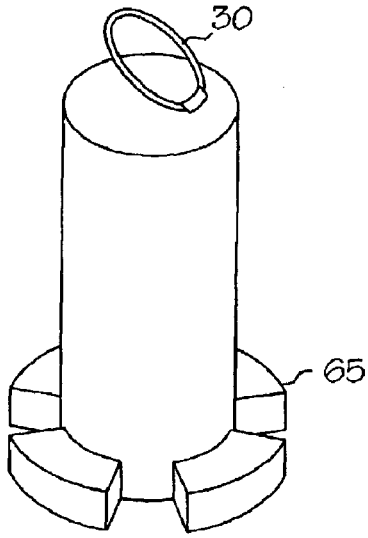
FIG. 8 depicts a schematic illustration of an exemplary coupling adapter according to the present invention.

Another embodiment of the present invention depicted in FIG. 7 comprises an improved paint roller 20 with an end cap 25, wherein the end cap 25 is configured to have an end cap socket 60. The end cap socket 60 may be configured to any configuration known to one skilled in the art to allow an adapter 65 or key to be inserted and to be secured to the end cap 25 of the paint roller 20. One exemplary adapter is depicted in FIG. 8. The male adapter 65 comprises a corresponding configuration which can be inserted into the end cap socket 60 of the end cap 25 of the paint roller to secure the male adapter 65 to the end cap 25. The male adapter 65 further comprises a removal interface 30 configured to allow a user to exert force on the removal interface and male adapter 65 connected to the end cap 25 to allow for removal of the paint roller 20 from a paint roller frame.

Figure 10:
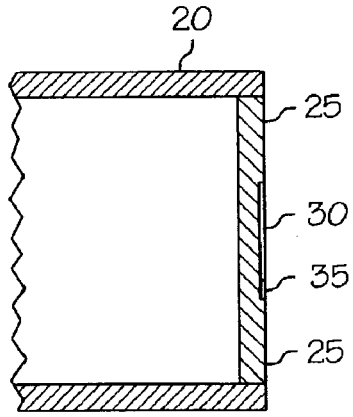
FIG. 10 depicts a schematic cross-section illustration of an exemplary paint roller according to the present invention.
Figure 11A:
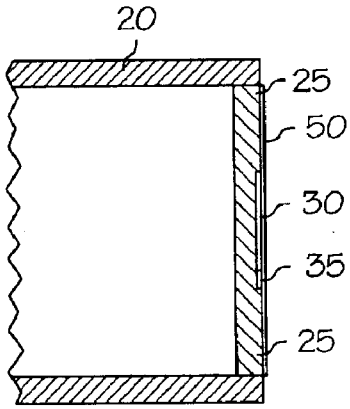
FIG. 11A depicts a schematic cross-section illustration of an exemplary paint roller according to the present invention.
Figure 11B:
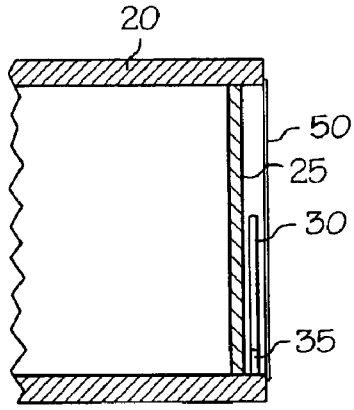
FIG. 11B depicts a schematic cross-section illustration of an exemplary paint roller according to the present invention.

FIG. 10 depicts cross-sectional side view of the improved paint roller 20. In one embodiment, the ring 30 and ring securing bracket or hinge 35 are configured to be flush with or recessed within the end cap 25 on the paint roller 20. In another exemplary embodiment as depicted in FIG. 11A, a removal mask 50 is placed over the end cap 25 flush with the end of the paint roller 20, wherein the end cap 25 comprises a ring 30 and ring securing bracket or hinge 35 being flush with the end cap 25. In another exemplary embodiment as depicted in FIG. 11B, a removal mask 50 is placed over the end cap 25 flush with the end of the paint roller 20, wherein the end cap 25 comprises a ring 30 and ring securing bracket or hinge 35 recessed within the end cap 25.

Figure 12A:
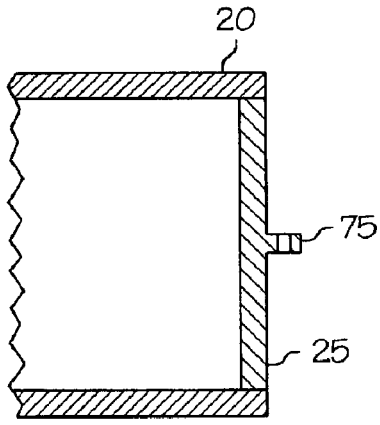
FIG. 12A depicts a schematic illustration of a side view of an exemplary paint roller according to the present invention.
Figure 12B:
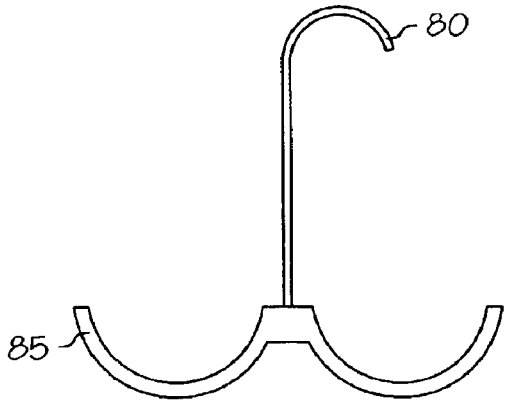
FIG. 12B depicts a schematic illustration of an exemplary hook according to the present invention.
Figure 12C:
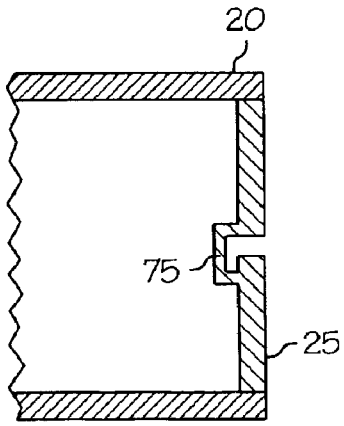
FIG. 12C depicts a schematic cross-section illustration of an exemplary paint roller according to the present invention.

Another exemplary embodiment of the present invention is depicted in FIGS. 12A, 12B and 12C. In this embodiment, the improved paint roller 20 comprises an end cap 25 having a eyelet 75. The eyelet 75 is configured to receive a hook 80, wherein the hook 80 is configured to allow a user to apply force to the paint roller and remove the paint roller 20 from the paint roller frame. One exemplary embodiment of the hook 80 is depicted in FIG. 12B. The hook 80 further comprises a finger grip 85 allowing the user to grip the hook 80 and apply a force to the paint roller 20 when the hook 80 is in communication with the eyelet 75 to remove the paint roller 20 from the paint roller frame. In another embodiment of the invention depicted in FIG. 12C, the eyelet 75 of the end cap is located within the end cap 25 at the distal end 24 of the paint roller. In this embodiment, the hook 80 is inserted into the end cap 25 and secured in the eyelet 75 on the interior of the end cap 25. Force can then be applied to the hook 80 to remove the paint roller 20 from the paint roller frame.

Figure 13:
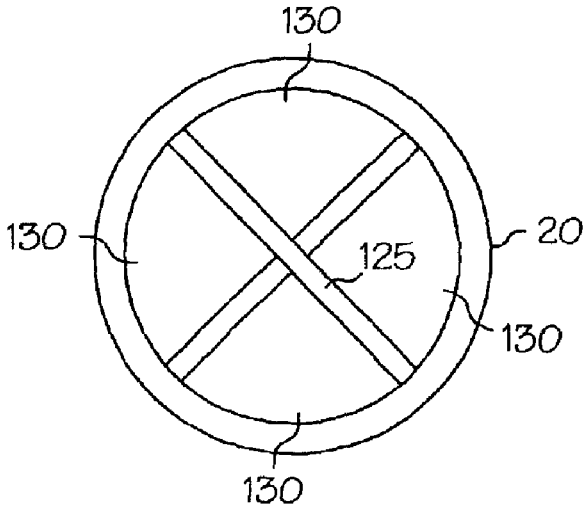
FIG. 13 depicts a schematic illustration of an end view of an exemplary paint roller according to the present invention.

Another exemplary embodiment of the present invention is depicted in FIG. 13. On the distal end 24 of the paint roller 20, a criss-cross mechanism 125 allows a user to insert a digit in the open area 130 of the criss-cross mechanism 125 and grip the criss-cross mechanism 125 and exert force on the criss-cross mechanism 125 and the paint roller 20 to separate the paint roller 20 from the paint roller frame. Alternative embodiments for the criss-cross mechanism 125 may comprise an eyelet 75 sized to receive a human digit allowing a human digit to be inserted into a hole and to exert force by pulling from the eyelet to remove the paint roller 20 from the paint roller frame. In addition, a removable mask may cover the criss-cross mechanism 125 or eyelet 75 to minimize contact with paint.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. Accordingly, this invention is intended to embrace all alternatives, modifications, and variations that have been discussed herein, and others that fall within the spirit and broad scope of the claims.

What is claimed is:

1. An improved paint roller for easy removal from a paint roller frame, comprising:

a paint roller tube having a proximal and distal end;

an end cap attached to or recessed within the distal end of the paint roller tube; and a removal interface attached to the end cap, wherein the removal interface is configured to aid in removal of the paint roller from a paint roller frame;

and wherein the removal interface is configured such that the removal interface remains attached to the paint roller during removal of the paint roller from the paint roller frame.

2. The paint roller of claim 1, further comprising a removable mask covering at least a portion of the end cap of the paint roller.

3. The paint roller of claim 2, wherein the removable mask comprises a metal foil.

4. The paint roller of claim 2, wherein the removable mask comprises a plastic sheet.

5. The paint roller of claim 2, wherein the removable mask comprises a non-woven fiber.

6. The paint roller of claim 2, wherein the removable mask comprises a paper layer.

7. The paint roller of claim 1, wherein the end cap further comprises a non-stick surface.

8. The paint roller of claim 1, wherein the removal interface comprises a ring, wherein the ring is configured to allow a user to exert force to remove the paint roller from a paint roller frame.

9. The paint roller of claim 1, wherein the end cap is configured to allow the removal interface to be flush with the end cap.

10. The paint roller of claim 1, wherein the end cap is coated with a non-stick coating.

11. The paint roller of claim 1, wherein the end cap is configured to allow the removal interface to be recessed within the end cap.

12. The paint roller of claim 1, wherein the end cap is formed integral with the paint roller tube.

13. The paint roller of claim 12, wherein the end cap is molded with the paint roller tube.

14. The paint roller of claim 12, wherein the end cap is extruded with the paint roller tube.

15. An improved paint roller having a distal and proximal end, comprising:

an end cap attached to the distal end of the paint roller, wherein the end cap is configured to allow removal of the paint roller from a paint roller frame while minimizing a user's contact with the paint roller; and wherein the end cap is configured such that the end cap remains attached to the paint roller during removal of the paint roller from the paint roller frame.

16. The paint roller of claim 15, wherein the end cap comprises a socket, wherein the socket comprises a female receptor configured to receive a male adapter.

17. The paint roller of claim 15, wherein the end cap is configured to allow a ring to be attached to the end cap.

* * * * *